US006165967A

United States Patent [19]

Prada-Silvy et al.

[11] Patent Number: 6,165,967

[45] Date of Patent: Dec. 26, 2000

[54] HAND WASH LAUNDRY DETERGENT COMPOSITIONS CONTAINING A COMBINATION OF SURFACTANTS

[75] Inventors: Ricardo Alfredo Prada-Silvy, Caracas, Venezuela; Francisco Ramón Figueroa, Tyne & Wear, United Kingdom; Ricardo Alberto Icaza-Franceschi, Miami, Fla.; Ricardo Leal-Macias, San Angel; Edgar Manuel Marin-Carrillo, Mexico City, both of Mexico

[73] Assignee: The Procter & Gamble Company, Cincinnati, Ohio

[21] Appl. No.: 09/214,588

[22] PCT Filed: Jul. 8, 1997

[86] PCT No.: PCT/US97/11944

§ 371 Date: Feb. 26, 1999

§ 102(e) Date: Feb. 26, 1999

[87] PCT Pub. No.: WO98/01521

PCT Pub. Date: Jan. 15, 1998

Related U.S. Application Data

[60] Provisional application No. 60/021,338, Jul. 8, 1996.

[51] Int. Cl.[7] ..... C11D 1/65; C11D 1/62; C11D 3/386

[52] U.S. Cl. ..... 510/428; 510/300; 510/302; 510/315; 510/320; 510/322; 510/323; 510/329; 510/340; 510/341; 510/352; 510/367; 510/378; 510/392; 510/467; 510/504; 510/507; 510/510; 510/515

[58] Field of Search ..... 510/428, 300, 510/302, 315, 320, 322, 323, 329, 340, 341, 352, 367, 378, 392, 467, 504, 508, 510, 515

[56] References Cited

U.S. PATENT DOCUMENTS

| | | | |
|---|---|---|---|
| 4,326,971 | 4/1982 | Wixon | 252/8.75 |
| 4,338,204 | 7/1982 | Spadini et al. | 252/8.75 |
| 4,973,422 | 11/1990 | Schmidt | 252/174.11 |
| 5,160,641 | 11/1992 | Foster | 252/8.6 |
| 5,629,278 | 5/1997 | Baeck et al. | 510/236 |
| 5,679,630 | 10/1997 | Baeck et al. | 510/305 |
| 5,707,950 | 1/1998 | Kasturi et al. | 510/320 |
| 5,759,208 | 6/1998 | Zhen et al. | 8/137 |

FOREIGN PATENT DOCUMENTS

| | | | |
|---|---|---|---|
| 0051986 | 5/1982 | European Pat. Off. | C11D 1/86 |
| WO 95/33035 | 12/1995 | WIPO | C11D 1/65 |
| WO 96/05280 | 2/1996 | WIPO | C11D 1/75 |
| WO 97/03158 | 1/1997 | WIPO | C11D 1/62 |
| WO 97/03162 | 1/1997 | WIPO | C11D 1/62 |
| WO 97/03163 | 1/1997 | WIPO | C11D 1/62 |
| WO 97/03164 | 1/1997 | WIPO | C11D 1/62 |
| WO 97/12018 | 4/1997 | WIPO | C11D 1/65 |

*Primary Examiner*—Yogendra Gupta
*Assistant Examiner*—Charles Boyer
*Attorney, Agent, or Firm*—Marianne Dressman; Kim William Zerby; Steven W. Miller

[57] ABSTRACT

Laundry granular detergent compositions useful for hand wash and machine-assisted hand wash laundry operations. The composition contains 5% to 40% of a surfactant, the surfactant containing: 1) 60% to 95% primary anionic surfactant selected from alkylbenzene sulfonate, alkyl sulfate, and mixtures thereof; and 2) 2.5% to 18% alkyl ethoxy ether sulfate (AES) surfactant having an average of from about 1 to about 9 moles ethoxy per mole surfactant, the ratio of alkylbenzene sulfate and alkyl sulfate surfactant to alkyl ethoxy ether sulfate surfactant being within the range of from about 30:1 to about 4:1. The composition also preferably contains 2.0% to 5.5% hydroxyalkyl quaternary ammonium cationic surfactant, the ratio of alkylbenzene sulfonate and alkyl sulfate surfactant to such cationic surfactant being from 40:1 to 16:1. The detergent laundry composition is mild to the hands, and provides superior cleaning performance under high hardness and underbuilt wash conditions, and improved cleaning performance on greasy and body soils. The incorporation of the AES surfactant into the surfactant system also provides improved cellulase enzyme activity on cellulose substrates washed in the detergent composition.

4 Claims, No Drawings

HAND WASH LAUNDRY DETERGENT COMPOSITIONS CONTAINING A COMBINATION OF SURFACTANTS

This application claims the benefit of U.S. Provisional application No. 60/021338 filed Jul. 8, 1996.

TECHNICAL FIELD

The subject invention involves hand wash and machine-assisted hand wash laundry detergent compositions containing a certain mixture of surfactants.

BACKGROUND OF THE INVENTION

Throughout the world, many people clean fabrics by hand washing or machine-assisted hand washing with compositions containing soap and/or detergent. Machine-assisted hand washing of fabrics involves the use of a manual or semi-automatic wash machine with completion of the wash process by hand washing.

In many geographies where hand washing is prevalent, the water hardness of calcium and magnesium ions can be as high as 25 grains/gal as equivalent CaCO3, or higher. Under such high hardness conditions, the builder capacity of the laundry detergent to sequester all the hardness can be exhausted. In this condition, conventional surfactant systems lose their cleaning performance capability, or at least their cleaning performance is substantially less than in conditions where the builder system can sequester substantially all hardness.

Furthermore, hand-wash laundry detergent compositions are preferably formulated to provide good cleaning, including adequate cleaning on greasy and body soil stains, while remaining mild to the skin of the hands. In general, there remains a need to improve the cleaning of these soils while maintaining good mildness on the hands.

Effective hand wash detergent compositions comprise anionic surfactants, particularly alkylbenzene sulfonate and alkyl sulfate surfactants. It has also been found beneficial for the appearance and cleaning of cotton fabrics for hand wash laundry detergents to contain an amount of a cellulase enzyme sufficient to improve the appearance and cleaning of such fabrics, particularly after multiple cleaning cycles. However, it is known that the presence of anionic surfactants can inhibit the activity of the cellulase enzymes, thereby reducing the effectiveness of the cellulase to deliver the appearance and cleaning improvements.

European Patent Application 0,051,986 (The Procter & Gamble Company) discloses a granular detergent composition containing mixtures of anionic surfactant, preferably alkylbenzene sulfonate and alkyl sulfate, and mixtures thereof with soap, an alkoxylated nonionic surfactant, and a water soluble cationic surfactants.

It is an object of the subject invention to provide a detergent laundry composition which provides superior cleaning performance in hand wash or machine-assisted hand wash laundry operations.

Another object of the present invention is to provide a surfactant system for a detergent composition which can maintain good cleaning performance under high hardness conditions even after the builder capacity of the laundry detergent composition to sequester the hardness in wash water has been stressed or exhausted.

It is a further object to provide a hand wash detergent composition which provides improved cleaning performance on greasy and body soils without diminishing the mildness of the product on the hands.

It is yet another object of the present invention to provide a synergistic surfactant system containing alkylbenzene sulfonate surfactant which minimizes interferance with the activity of cellulase enzymes toward cellulosic fabric substrate.

It is another object to provide the above-mentioned benefits while maintaining good sudsing of the detergent composition during hand washing.

SUMMARY OF THE INVENTION

The subject invention involves laundry detergent compositions, preferably in granular form, comprising:

a) from about 5% to about 40% surfactant system, the surfactant system consisting of:
   1) from about 60% to about 95% of primary anionic surfactant selected from alkylbenzene sulfonate, alkyl sulfate, and mixtures thereof;
   2) from about 2.5% to about 18% alkyl ethoxy ether sulfate surfactant having an average of from about 1 to about 9 moles ethoxy per mole surfactant, the ratio of primary anionic surfactant to alkyl ethoxy ether sulfate surfactant being within the range of from about 30:1 to about 4:1;
   3) from about 2.0% to about 5.5% hydroxyalkyl quaternary ammonium cationic surfactant having the structure:

R R'nR"mN+Z-, wherein R is long-chain alkyl, R' is short-chain alkyl, R" is independently $(O—R^3)_Z$ where $R^3$ is ethyl or propyl, and wherein Z is a number averaging about 1 to about 4, and where R" is preferably hydroxyethyl or hydroxypropyl; n is 1 or 2, m is 1 or 2, n+m is 3, Z- is an anion; the ratio of primary anionic surfactant to such cationic surfactant being with the range of from about 40:1 to about 16:1; and 4) from 0% to about 15% alkyl ethoxy alcohol surfactant having an average of from about 1 to about 10 moles ethoxy per mole surfactant, the ratio of primary anionic surfactant to alkyl ethoxy alcohol surfactant being greater than about 4.5:1;

b) from about 60% to about 95% other components.

The subject invention also involves granular detergent compositions comprising:

a) from about 5% to about 40% surfactant system, the surfactant system consisting of:
   1) from about 60% to about 95% of primary anionic surfactant selected from alkylbenzene sulfonate, alkyl sulfate, and mixtures thereof, and
   2) from about 2.5% to about 18% alkyl ethoxy ether sulfate surfactant having an average of from about 1 to about 9 moles ethoxy per mole surfactant, the ratio of alkylbenzene sulfonate and alkyl sulfate surfactant to alkyl ethoxy ether sulfate surfactant being within the range of from about 30:1 to about 4:1; and
   3) from about 2.0% to about 5.5% hydroxyalkyl quaternary ammonium cationic surfactant having the structure:

R R'nR"mN+Z-, wherein R is long-chain alkyl, R' is short-chain alkyl, R" is independently $(O—R^3)_Z$ where $R^3$ is ethyl or propyl, and wherein Z is a number averaging about 1 to about 4, and where R" is preferably hydroxyethyl or hydroxypropyl; n is 1 or 2, m is 1 or 2, n+m is 3, Z- is an anion; the ratio of primary anionic surfactant to such cationic surfactant being with the range of from about 40:1 to about 16:1; and b) cellulase enzyme having an activity of from about 1 CEVU to about 10 CEVU per gram of the composition.

DETAILED DESCRIPTION OF THE INVENTION

All percentages used herein are weight percent unless otherwise specified.

As used herein, the term "alkyl" means a hydrocarbyl moiety which is straight (linear) or branched, saturated or unsaturated. Unless otherwise specified, alkyl are preferably saturated ("alkanyl") or unsaturated with double bonds ("alkenyl"), preferably with one or two double bonds. As used herein "long-chain alkyl" means alkyl having about 8 or more carbon atoms, and "short-chain alkyl" means alkyl having about 3 or fewer carbon atoms.

The term "tallow" is used herein in connection with materials having alkyl mixtures derived from fatty acid mixtures from tallow which typically are linear and have an approximate carbon chain length distribution of 2% $C_{14}$, 29% $C_{16}$, 23% $C_{18}$, 2% palmitoleic, 41% oleic, and 3% linoleic (the first three listed being saturated). Other mixtures with similar alkyl distribution, such as those from palm oil and those derived from various animal tallows and lard, are also included with the term tallow. The tallow, as used herein, can also be hardened (i.e. hydrogenated) to convert part or all of the unsaturated alkyl moieties to saturated alkyl moieties.

The term "coconut" is used herein in connection with materials having alkyl mixtures derived from fatty acid mixtures from coconut oil which typically are linear and have an approximate carbon chain length distribution of about 8% $C_8$, 7% $C_{10}$, 48% $C_{12}$, 17% $C_{14}$, 9% $C_{16}$, 2% $C_{18}$, 7% oleic, and 2% linoleic (the first six listed being saturated). Other mixtures with similar alkyl distribution, such as palm kernel oil and babassu oil, are included within the term coconut.

Compositions of the subject invention are preferably in solid, granular form, although other forms of laundry detergents are also included.

Surfactants

Compositions of the subject invention comprise from about 5%, preferably from about 10%, more preferably from about 15%, even more preferably from about 18%, and most preferably from about 20% surfactant system, and up to about 40%, preferably up to about 35% surfactant, more preferably up to about 30% surfactant, and even more preferably up to about 25% surfactant system.

a) Primary Anionic Surfactant

The surfactant system of the subject compositions contains a lower level of from about 60%, preferably from about 70%, and even more preferably from about 80% primary anionic surfactant selected from alkylbenzene sulfonate, alkyl sulfate, and mixtures thereof, to an upper level of about 95%, preferably of about 93%, more preferably of about 91%, even more preferably of about 88% primary anionic surfactant.

The ratio of alkylbenzene sulfonate surfactant to alkyl sulfate surfactant in the subject composition is preferably at least about 1:1, more preferably at least about 2:1, more preferably still at least about 4:1, and even more preferably such surfactants are all alkylbenzene sulfonate surfactants.

As used herein, "alkylbenzene sulfonate surfactants" or "alkylbenzene sulfonates" means salts of alkylbenzene sulfonic acid with an alkyl portion which is linear or branched, preferably having from about 8 to about 18 carbon atoms, more preferably from about 9 to about 16 carbon atoms. The alkyl of the alkylbenzene sulfonic acid preferably have an average chain length of from about 10 to about 14 carbon atoms, more preferably from about 11 to about 13 carbon atoms. The alkyl are preferably saturated. Branched or mixed branched alkylbenzene sulfonates are known as ABS. Linear alkylbenzene sulfonates, known as LAS, are more biodegradable than ABS, and are preferred for the subject invention compositions. The acid forms of ABS and LAS are referred to herein as HABS and HLAS, respectively.

The salts of the alkylbenzene sulfonic acids are preferably the alkali metal salts, such as sodium and potassium, especially sodium. Salts of the alkylbenzene sulfonic acids also include ammonium.

A particularly preferred LAS surfactant has saturated linear alkyl with an average of 11.5 to 12.5 carbon atoms, and is a sodium salt ($C_{11.5-12.5}$LAS.Na).

Alkylbenzene sulfonates and processes for making them are disclosed in U.S. Pat. Nos. 2,220,099 and 2,477,383, incorporated herein by reference.

As used herein, "alkyl sulfates" (AS) include the salts of alkyl sulfuric acids, preferably having carbon chain lengths in the range of from about $C_{10}$ to about $C_{20}$. Alkyl sulfates having chain lengths from about 12 to about 18 carbon atoms are preferred. AS surfactants preferably have average chain lengths from about 12 to about 14 carbon atoms. Especially preferred are the alkyl sulfates made by sulfating primary alcohols derived from coconut or tallow and mixtures thereof.

Salts of alkyl sulfates include sodium, potassium, lithium, ammonium, and alkylammonium salts. Preferred salts of alkyl sulfates are sodium and potassium salts, especially sodium salts.

b) Alkyl Ethoxy Ether Sulfate

The surfactant system of the subject compositions also contains from about 2.5%, preferably from about 5%, more preferably from about 6%, even more preferably from about 6.5% and most preferably from about 7% AES surfactant, and up to about 18%, preferably up to about 12%, more preferably up to about 9%, and even more preferably up to about 8%, AES surfactant.

In the subject development compositions, the ratio of primary anionic surfactant to alkyl ethoxy ether sulfate surfactant is within the range having an upper ratio of from about 25:1, preferably from about 19:1, more preferably from about 17:1, even more preferably from about 15:1, and most preferably from about 13.1, to a lower ratio of about 4:1, preferably of about 8:1, more preferably of about 10:1, and even more preferably of about 11:1.

The alkyl ethoxy ether sulfate (AES) surfactants useful in the subject invention compositions have the following structure:

$$R'''O(C_2H_4O)_xSO_3M.$$

In the above structure, R''' is alkyl of from about 10 to about 20 carbon atoms. On average, R''' is from about 11 to about 18, preferably from about 12 to about 15, carbon atoms. R''' is preferably saturated. R''' is preferably linear.

In the above structure, x represents the "degree of ethoxylation" (number of ethoxy moieties per molecule) which can have a broad distribution for the AES surfactants of the subject compositions. This is because, when a raw material alkyl alcohol is ethoxylated with ethylene oxide to form the alkyl ethoxy ether (prior to sulfation), a broad distribution of the number of ethoxy moieties per molecule results. In the above structure, x is on average from about 1 to about 9, preferably from about 1 to about 7, more preferably from about 2 to about 5, especially about 3.

In the above structure, M is a water-soluble cation, for example, an alkali metal cation (e.g., sodium, potassium, lithium), an alkaline earth metal cation (e.g., calcium, magnesium), ammonium or substituted-ammonium cation. M is preferably sodium or potassium, especially sodium.

The AES surfactants are typically obtained by sulfating alkyl ethoxy alcohols with gaseous $SO_3$ in a falling film reactor, followed by neutralization with NaOH, as is well known in the art.

c) Hydroxyalkyl Quaternary Ammonium Cationic Surfactants

The surfactant system of the subject compositions also contains from about 2.0%, preferably from about 2:5%, more preferably from about 2.7%, and even more preferably from about 2.8% HAQA surfactant, to about 5.5%, preferably to about 4.5%, and even more preferably of about 3.5% HAQA surfactants.

In the subject development compositions, the ratio of primary anionic surfactant to HAQA surfactants is within the range having an upper ratio of from about 40:1, preferably from about 38:1, even more preferably from about 35:1, and most preferably from about 30:1, to a lower ratio of about 16:1, preferably to about 20:1, and even more preferably to about 25.1.

The hydroxyalkyl quaternary ammonium (HAQA) cationic surfactants useful in the subject invention compositions have the following structure:

$$R\,R'_n R''_m N^+ Z^-.$$

R is a long-chain alkyl, linear or branched, having from about 8 to about 18, preferably from about 9 to about 16, carbon atoms. R preferably has an average of from about 10 to about 15, more preferably from about 12 to about 14, carbon atoms. R is preferably saturated. R is preferably linear. R' is short-chain alkyl having from 1 to about 3 carbon atoms; R' is preferably methyl or ethyl, especially methyl. R" is independently $(O—R^3)_Z$ where $R^3$ is ethyl or propyl, and wherein Z is a number averaging about 1 to about 4. R" is preferably hydroxyethyl or hydroxypropyl, and most preferably hydroxyethyl. n is 1 or 2, preferably 2. m is 1 or 2, preferably 1. n+m is 3. $Z^-$ is a water soluble anion, such as halide, sulfate, methylsulfate, ethylsulfate, phosphate, hydroxide, fatty acid (laurate, myristate, palmitate, oleate, or stearate), or nitrate anion. Preferably $Z^-$ is selected from chloride, bromide and iodide, and is most preferably chloride.

d) Alkyl Ethoxy Alcohol Surfactant

The surfactant system of the subject compositions also can contain from 0% to about 15%, preferably from about 1% to about 8%, more preferably from about 1.5% to about 4%, more preferably still from about 2% to about 3.5%, alkyl ethoxy alcohol surfactant.

In the subject development compositions, the ratio of primary anionic surfactant to alkyl ethoxy alcohol surfactant is greater than about 4.5:1, preferably from about 60:1 to about 10:1, more preferably from about 50:1 to about 20:1, more preferably still from about 45:1 to about 30:1.

The alkyl ethoxy alcohol (AE) surfactants useful in the subject invention compositions are ethoxylated fatty alcohols.

These surfactants have an alkyl of from about 10 to about 20 carbon atoms. On average, the alkyl is from about 11 to about 18, preferably from about 12 to about 15 carbon atoms. The alkyl is preferably saturated. The alkyl is preferably linear.

The alkyl ethoxy alcohol surfactants have a "degree of ethoxylation" (number of ethoxy moieties per molecule) which can have a broad distribution because, when a raw material alkyl alcohol is ethoxylated with ethylene oxide, a broad distribution of the number of ethoxy moieties per molecule results. For the AE surfactants, the degree of ethoxylation is, on average, from about 1 to about 10, preferably from about 3 to about 9, more preferably from about 5 to about 8, especially about 7.

The surfactant system of the subject compositions preferably includes only, or substantially only, the surfactants disclosed hereinabove, such that the surfactant system of the subject compositions consists of, or consists essentially of, alkylbenzene sulfonate and/or alkyl sulfate surfactants (more preferably alkylbenzene sulfonate surfactants). AES surfactants, HAQA surfactants, and AE surfactants. However, minor amounts of other auxiliary surfactants, including anionic surfactants, nonionic surfactants, cationic surfactants, amphoteric surfactants, and zwitterionic surfactants can also be used, so long as they do not significantly interfere with the benefits of the surfactant system. Such auxiliary surfactants may include $C_{10}$–$C_{18}$ alkyl alkoxy carboxylates (especially the $ethoxy_{1-5}$ carboxylates) $C_{10}$–$C_{18}$ glycerol ethers, $C_{10}$–$C_{18}$ alkyl polyglycosides and their corresponding sulfated polyglycosides, and $C_{12}$–$C_{18}$-alpha-sulfonated fatty acid esters. Such auxiliary surfactants may include one or more of $C_6$–$C_{12}$ alkyl phenol alkoxylates (especially ethoxylates and mixed ethoxylates/propoxylates), $C_{12}$–$C_{18}$ betaines and sulfobetaines (sultaines), and $C_{10}$–$C_{18}$ amine oxides. Such auxiliary surfactants may include $C_{10}$–$C_{18}$ N-alkyl polyhydroxy fatty acid amides, such as $C_{12}$–$C_{18}$ N-methyl glucamides (see PCT Application WO 92/06154); other sugar-derived surfactants include N-alkoxy polyhydroxy fatty acid amides, such as $C_{10}$–$C_{18}$ N-(3-methoxy propyl) glucamide. Conventional $C_{10}$–$C_{20}$ fatty acid soaps are also possible auxiliary surfactants. Such auxiliary surfactants, if present, can be included at levels up to a total of about 10%, preferably about 0.5–3%.

In addition, a hydrotrope, or mixture of hydrotropes, can be present in the subject compositions. Preferred hydrotropes include the alkali metal, preferably sodium, salts of toluene sulfonate, xylene sulfonate, cumene sulfonate, sulfosuccinate, and mixtures thereof. Preferably, the hydrotrope, in either the acid form or the salt form, and being substantially anhydrous, is added to the linear alkylbenzene sulfonic acid prior to its neutralization. The hydrotrope, if present, is preferably from about 0.5% to about 5% of the subject compositions.

While it is known that an LAS surfactant will sequester and be precipitated from wash solution by divalent metal ions, such as calcium, under high water hardness conditions, it has been found that the presence of HAQA cationic surfactant further causes a greater proportion of the LAS surfactant to precipitate. Precipitation of the LAS under high hardness conditions reduces the cleaning power of the detergent composition, since precipitated LAS is unavailable for the cleaning function. The use of low levels of AES surfactant, at the proportions described herein, in a surfactant system which also contains the primary anionic surfactant and the HAQA cationic surfactant, substantially reduces the tendancy of the anionic surfactant, notably of LAS, to precipitation by interaction with divalent cations under high wash-water hardness and underbuilt wash conditions. In general, high hardness condition are wash solutions having about 16 grains per gallon (gpg) or more of divalent metal ions (such as calcium, magnesium and others) expressed in terms of equivalent $CaCO_3$, more preferably about 25 gpg or more. Such conditions are prevalent in many countries, and are particularly troublesome to wash performance under hand-wash conditions.

Other Components

The compositions of the subject invention comprise from about 60% to about 95%, preferably from about 65% to about 90%, more preferably from about 70% to about 85%, more preferably still from about 75% to about 80%, other components commonly used in laundry detergent products. A typical listing of the classes and species of other surfactants, builders and other ingredients that may be included in the subject compositions appears in U.S. Pat. No. 3,664,961, issued to Norris on May 23, 1972, incorporated herein by reference, and EP 550,652, published on Apr. 16, 1992. The following are representative of such materials, but are not intended to be limiting.

Detergent Builders

The compositions of the subject invention preferably comprise detergent builders which assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%, more typically from about 15% to about 50% by weight, of detergent builder. Lower or higher levels of builder, however, are not meant to be excluded.

While detergent compositions are typically formulated to clean well under all wash conditions, the detergent composition of the present invention, like any detergent, may often be used under wash conditions using a wash water having high hardness, and which can be a hardness well above the capacity of the builder system to sequester and control. When the wash water hardness is close to or exceeds the builder capacity of the detergent composition, resulting in an underbuilt wash condition, the unsequestered water hardness can interfere with the alkylbenzene sulfonate surfactant cleaning performance. Specifically, alkylbenzene sulfonate surfactant can act as a sequestering agent for the unsequestered hardness (specifically calcium ions). Sequestration of hardness interferes with performance of the alkylbenzene sulfonate as a cleaning surfactant. The improved surfactant system of the present invention uses a low level of AES surfactant to interfere with the sequestration of calcium ions by the alkylbenzene sulfonate. Consequently, low levels of AES in accordance with the present invention maintains good alkylbenzene sulfonate surfactant cleaning performance even under underbuilt wash conditions.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), and aluminosilicates. Non-phosphate builders are required in some locales. Importantly, the subject compositions function surprisingly well even in the presence of the so-called "weak" builders (as compared with phosphates) such as citrate, or in the so-called "underbuilt" situation that may occur with zeolite or layered silicate builders, or with low levels of P-containing builders.

In situations where phosphorus-based builders can be used, the various alkali metal phosphates such as the well-known sodium tripolyphosphates (STPP), sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030, 3,422,021; 3,400,148 and 3,422,137) can also be used.

Examples of silicate builders are the alkali metal silicates, particularly those having a $SiO_2$:$Na_2O$ ratio in the range of about 1.6:1 to about 3.2:1, preferably about 1.6:1; and layered silicates, such as the layered sodium silicates described in U.S. Pat. No. 4,664,839, issued May 12, 1987 to Rieck. Other silicates may also be useful, such as, for example, magnesium silicate, which can serve as a crispening agent in granular formulations, as a stabilizing agent for oxygen bleaches, and as a component of suds control systems.

Examples of carbonate builders are the alkali metal carbonates and bicarbonates as disclosed in German Patent Application No. 2,321,001 published on Nov. 15, 1973. Preferred is sodium carbonate.

Aluminosilicate builders are useful in the subject compositions. Aluminosilicate builders are of great importance in many currently marketed granular detergent compositions. Aluminosilicate builders include those having the empirical formula:

$$M_z(zAlO_2)_y.vH_2O$$

wherein z and y are integers of at least 6, the molar ratio of z to y is in the range from 1.0 to about 0.5, and v is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al., issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}((AlO_2)_{12}(SiO_2)_{12}).vH_2O$$

wherein v is from about 20 to about 30, especially about 27. This material is known as Zeolite A. Dehydrated zeolites (v=about 0–10) may also be used. Preferably, the aluminosilicate has a particle size of about 0.1–10 microns in diameter.

Organic detergent builders suitable for the subject compositions include, but are not restricted to, a wide variety of polycarboxylate compounds. As used herein, "polycarboxylate" refers to compounds having a plurality of carboxylate groups, preferably at least 3 carboxylates. Polycarboxylate builders can generally be added to the compositions in acid form, but can also be added in the form of neutralized salts. When utilized in salt form, alkali metals, such as sodium, potassium, and lithium, or alkanolammonium salts are preferred.

Citrate builders, e.g., citric acid and soluble salts thereof (particularly sodium salt), are polycarboxylate builders available from renewable resources and are biodegradable. Citrates can be used in granular compositions, especially in combination with zeolite and/or layered silicate builders. Oxydisuccinates are also useful in such compositions and combinations.

Also suitable in the subject detergent compositions are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkanyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecnylsuccinate (preferred), 2-pentadecenylsuccinate, and the like. Laurylsuccinates are preferred builders of this group, and are described in European Patent Application 200 263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocaboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

The compositions of the subject invention comprise from 0% to about 70% builders, preferably from about 10% to about 60%, more preferably from about 13% to about 40%, more preferably from about 20% to about 37%. The compositions preferably comprise from about 5% to about 45% of builders other than carbonates (including bicarbonates) and silicates (excluding zeolites), preferably selected from inorganic phosphate and zeolite builders (more preferably from inorganic phosphate builders), more preferably from about 14% to about 40%, more preferably still from about 18% to about 36%; STPP is preferred among such builders.

The subject compositions also preferably comprise from about 5% to about 19% sodium carbonate, more preferably from about 7% to about 15%, more preferably still from about 9% to about 13%. The subject compositions also preferably comprise from about 5% to about 12% silicates, more preferably from about 6% to about 10%, more preferably still from about 7% to about 8%.

Chelating Agents

The subject detergent compositions may also optionally contain one or more iron and/or manganese chelating agents. Such chelating agents can be selected from the group consisting of amino carboxylates, amino phosphonates, polyfunctionally-substituted aromatic chelating agents and mixtures thereof. Without intending to be bound by theory, it is believed that the benefit of these materials is due in part to their exceptional ability to remove iron and manganese ions from washing solutions by formation of soluble chelates. These agents are also useful in stabilizing bleaching components of the subject compositions.

Amino carboxylates useful as optional chelating agents include ethylenediamine tetracetates, N-hydroxyethylethylenediamine triacetates, nitrilotriacetates, ethylenediamine tetraproprionates, triethylenetetraamine hexacetates, diethylenetriamine pentaacetates, and ethanoldiglycines, alkali metal, ammonium, and substituted ammonium salts thereof and mixture thereof.

Amino phosphonates are also suitable for use as chelating agents in the subject compositions, when at least low levels of total phosphorus are permitted in detergent compositions. Preferably, these amino phosphonates do not contain alkanyl or alkenyl groups with more than about 6 carbon atoms. Preferred amino phosphonates are diethylenetriamine penta (methylene phosphonic acid), ethylenediamine tetra (methylene phosphonic acid), and mixtures and salts and complexes thereof. Particularly preferred are sodium, zinc, magnesium, and aluminum salts and complexes thereof, and mixtures thereof. Preferably such salts or complexes have a molar ratio of metal ion to chelant molecule of at least about 1:1, preferably at least about 2:1.

Such chelants can be included in the subject compositions at a level up to about 5%, preferably from about 0.1% to about 2%, more preferably from about 0.2% to about 1.5%, more preferably still from about 0.5% to about 1%.

Polymeric Dispersing Agents

The subject compositions preferably comprise polymeric dispersing agents. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Particularly suitable polymeric polycarboxylates can be derived from acrylic acid. Such acrylic acid-based polymers which are useful are the water-soluble salts of polymerized acrylic acid. The average molecular weight of such polymers in the acid form preferably ranges from about 2,000 to about 10,000, more preferably from about 4,000 to about 7,000 and most preferably from about 4,000 to about 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to about 100,000, more preferably from about 5,000 to about 75,000, most preferably from about 7,000 to about 65,000. The ratio of acrylate to maleate segments in such copolymers will generally range from about 30:1 to about 1:1, more preferably from about 10:1 to about 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application 066 915, published Dec. 15, 1982, as well as in EP 193 360, published Sep. 3, 1986, which also describes such polymers comprising hydroxypropylacrylate. Still other useful dispersing agents include the maleic/acrylic/vinyl alcohol terpolymers. Such materials are also disclosed in EP 193 360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have an average molecular weight of about 10,000.

Another type of preferred antiredeposition agent includes the carboxymethylcellulose (CMC) materials. There materials are well-known in the art.

The above polymeric dispersing agent, if included, are typically at levels up to about 5%, preferably from about 0.2% to about 2.5%, more preferably from about 0.5% to about 1.5%. Polyacrylate and acrylic/maleic copolymer dispersing agents are preferably included in the subject compositions at a level of from about 0.3% to about 2%, more preferably from about 0.5% to about 1.5%. A CMC-type dispersing agent is preferably included in the subject compositions at a level of from about 0.1% to about 1.5%, more preferably from about 0.2% to about 1%.

A preferred ingredient in the subject compositions is a soil dispersing agent which is a water soluble or dispersible alkoxylated polyalkyleneamine material. Such material can be included in the subject compositions at a level up to about 1%, preferably from about 0.1% to about 0.8%, more preferably from about 0.3% to about 0.5%.

The alkoxylated polyalkyleneamine material has a polyalkyleneamine backbone of amine units having the general formula:

$$(H_2N—R^1—)_{q+1}(—NH—R^1—)_r(>N—R^1—)_q(—NH_2)$$

wherein:

(i) each $(H_2N—R^1—)$ unit is bonded to $(—NH—R^1—)$ or $>N—R^1—)$;

(ii) each $(—NH—R^1—)$ unit is bonded to any two units, provided that each is bonded to no more than one of $(H_2N—R^1—)$ and $(—NH_2)$;

(iii) each $(>N—R^1—)$ unit is bonded to any three units, provided that each is bonded to no more than two of $(H_2N—R^1—)$ and $(—NH_2)$;

(vii) the $(—NH_2)$ is bonded to $(—NH—R^1—)$ or $(>N—R^1—)$;

provided that each bond described in (i), (ii), (iii) and (iv) is between N or one unit and $R^1$ of another unit.

In the above general formula, q is on average from 0 to about 250, preferably from about 1 to about 100, more preferably from about 3 to about 40, more preferably still from about 5 to about 25, still more preferably from about 7 to about 15.

In the above general formula, r is on average from about 3 to about 700, preferably from about 4 to about 200, more preferably from about 6 to about 80, more preferably still from about 8 to about 50, still more preferably from about 15 to about 30.

In the above general formula, the ratio q:r is preferably from 0 to about 1:4, more preferably from about 1:1.5 to about 1:2.5, more preferably still about 1:2.

In the above general formula, $R^1$ is linear alkanylene having from 2 to about 12 carbon atoms, preferably from 2 to about 4 carbon atoms. For preferred polyalkyleneamine backbones, less than about 50% of the $R^1$ moieties have more than 3 carbon atoms, more preferably less than about 25% $R^1$ moieties have more than 3 carbon atoms, more preferably still less than about 10% $R^1$ moieties have more than 3 carbon atoms. More preferred $R^1$ is selected from ethylene, 1,2-propylene, 1,3-propylene, and mixtures thereof. For most preferred backbones, substantially all $R^1$ units are the same. Most preferred $R^1$ is ethylene.

The polyalkyleneamine backbone described above has a molecular weight of at least about 180 daltons, preferably has a molecular weight of from about 600 to about 5000 daltons, more preferably has a molecular weight of from about 1000 to about 2500 daltons.

On the above polyalkyleneamine backbone, from about 50% to about 100% of the hydrogens bonded to the nitrogens are substituted; preferably from about 90% to about 100% of the hydrogens bonded to the nitrogens are substituted; more preferably substantially all of the hydrogens bonded to the nitrogens are substituted.

Substituents for the hydrogens bonded to the nitrogens are poly(alkyleneoxy) units having the formula $$—(R^3O)_pR^2$$

In the above formula, $R^3$ is alkanylene having from 2 to about 6 carbon atoms, preferably from 2 to about 4 atoms. $R^3$ is preferably selected from ethylene, 1,2-propylene, and mixtures thereof. More preferably $R^3$ is ethylene.

In the above formula, $R^2$ is selected from hydrogen, alkanyl having from 1 to about 4 carbon atoms, and mixtures thereof. Preferably $R^2$ is hydrogen.

In the above formula, p is on average from about 1 to about 50, preferably from about 3 to about 10. In general, p preferably increases with increasing molecular weight of the polyalkyleneamine backbone.

Those skilled in the art of alkoxylation of polyalkyleneamines recognize that the "degree of ethoxylation" is defined as the average number of alkoxylations per nitrogen atom substituent site and may be expressed as a fractional number. A polyalkyleneamine may have a degree of ethoxylation equal to 1 or greater and still have less than 100% of the polyalkyleneamine backbone nitrogen substituent sites substituted.

The relative proportion of primary, secondary, and tertiary amine units in the polyalkyleneamine backbone will vary, depending on the manner of preparation of the backbone.

Preferred "polyalkyleneamine backbones" herein include both polyalkyleneamines (PAA's) and polyalkyleneimines (PAI's); preferred backbones are polyethyleneamine (PEA's) and polyethyleneimines (PEI's).

Polymeric Soil Release Agent

Known polymeric soil release agents, hereinafter "SRA", can optionally be employed in the subject detergent compositions. If utilized, SRA's will generally comprise up to about 5%, preferably from about 0.1% to about 3%, more preferably from about 0.5% to about 1.5%, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

SRA's can include a variety of charged, e.g., anionic or even cationic species, see U.S. Pat. No. 4,956,447, issued Sep. 11, 1990 to Gosselink, et al., as well as noncharged monomer units, and their structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, or course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, issued Nov. 6, 1990 to Scheibel et al. Other SRA's include the nonionic end-capped 1,2-propylene/polyoxyethylene terephthalate polyesters of U.S. Pat. No. 4,711,730, issued Dec. 8, 1987 to Gosselink et al. Other examples of SRA's include: the partly- and fully-anionic-end-capped oligomeric esters of U.S. Pat. No. 4,721,580, issued Jan. 26, 1988 to Gosselink, such as oligomers from ethylene glycol (EG), 1,2-propylene glycol (PG), dimethyl terephthalate (DMT), and Na-3,6-dioxa-8-hydroxyoctanesulfonate; the nonionic-capped block polyester oligomeric compounds of U.S. Pat. No. 4,702,857, issued Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, issued Oct. 31, 1989 to Maldonado et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

Another preferred SRA is an oligomer having empirical formula $$(CAP)_2(EG/PG)_5(T)_5(SIP)_1$$

which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two-end cap units derived from sodium 2-(2-hydroxyethoxy)-ethanesulfonate. Such SRA preferably further comprises from about 0.5% to 20%, by weight of the oligomer, of a crystallinity-reducing stabilizer, for example an anionic surfactant such as linear sodium dodecylbenzenesulfonate or a member selected from xylene-, cumene-, and toulene- sulfonates or mixtures thereof, these stabilizers or modifiers being introduced into the synthesis vessel, all as taught in U.S. Pat. No. 5,415,807, Gosselink et al., issued May 16, 1995, incorporated herein by reference. A preferred SRA of this type, designated SRA-1 herein, is made from sodium 2-(2-hydroxyethoxy)-ethanesulfonate, dimethyl terephthalate, dimethyl 5-sulfoisophthalate, sodium salt, ethylene glycol and propylene glycol. SRA-1 is a doubly end-capped ester with 12% by weight of linear sodium dodecylbenzenesulfonate as a stabilizer. SRA-1 and a method for making it are described in Example V of U.S. Pat. No. 5,415,807, columns 19–20.

Yet another group of preferred SRA's are oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000.

Preferred SEG and CAP monomers for the above esters include Na-2-(2-3-dihydroxypropoxy)ethanesulfonate (SEG), Na-2-(2-(2-hydroxyethoxy)ethoxy) ethanesulfonate (SE3) and its homologs and mixtures thereof and the products of ethoxylating and sulfonating allyl alcohol. Preferred SRA esters in this class include the product of transesterifying and oligomerizing sodium 2-(2-(2-hydroxy-ethoxy) ethoxy) ethanesulfonate and/or sodium 2(2-(2-(2-hydroxyethoxy)ethoxy)-ethoxy)ethanesulfonate, DMT, sodium 2-(2,3-dihydroxypropoxy)ethanesulfonate, EG, and PG using an appropriate Ti(IV) catalyst and can be designated as $(CAP)_2(T)_5(EG/PG)_{1.4}(SEG)_{2.5}(B)_{0.13}$ wherein CAP is $(NaO_3S(CH_2—CH_2O)_{3.5})$— and B is a unit from glycerin and the mole ratio EG/PG is about 1.7:1 as measured by conventional gas chromatography after complete hydrolysis.

SRA's also include: simple copolymeric blocks of ethylene terephthalate or propylene terephthalate with polyethylene oxide or polypropylene oxide terephthalate, see U.S. Pat. No. 3,959,230 to Hays, issued May 25, 1976 and U.S. Pat. No. 3,893,929 to Basadur, issued Jul. 8, 1975; cellulosic derivative such as the hydroxyether cellulosic polymers available as METHOCEL® from Dow; the $C_1$–$C_4$ alkyl celluloses and $C_4$ hydroxyalkyl celluloses, see U.S. Pat. No. 4,000,093, issued Dec. 28, 1976 to Nicol et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK.

Suitable SRA's characterized by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 of Kud et al. Commercially available examples include SOKALAN® SRA's such as SOKALAN HP-22®, available from BASF, Germany. Other SRA's are polyesters with repeat units containing 10–15% by weight of ethylene terephthalate together with 80–90% by weight of polyoxyethylene terephthalate derived from a polyoxyethylene glycol of average molecular weight about 300–5,000. Commercial examples include ZELCON 5126® from DuPont and MILEASE T® from ICI.

Additional classes of SRA's include: nonionic terephthalates using diisocyanate coupling agents to link polymeric ester structures, see U.S. Pat. No. 4,201,824, Violland et al. and U.S. Pat. No. 4,240,918 Lagasse et al.; and SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anyhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes of SRA's include: anionic terephthalate-based SRA's of the urethane-linked variety, see U.S. Pat. No. 4,201,824, Violland et al.; poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; graft copolymers, in addition to the SOKALAN® types from BASF, made by grafting acrylic monomers onto sulfonated polyesters. These SRA's assertedly have soil release and anti-redeposition activity similar to known cellulose ethers: see EP 279 134 A, 1988, to Rhone-Poulenc Chemie. Still other SRA classes include: grafts of vinyl monomers such as acrylic acid and vinyl acetate onto proteins such as caseins, see EP 457 205 A to BASF (1991); and polyester-polyamide SRA's prepared by condensing adipic acid, caprolactam, and polyethylene glycol, especially for treating polyamide fabrics, see Bevan et al., DE 2,335,044 to Unilever N. V., 1974. Other useful SRA's are described in U.S. Pat. Nos. 4,240,918, 4,787,989 and 4,525,524. All of the patent publications on SRA's referred to hereinabove are incorporated herein by reference.

Enzymes

Enzymes can be included in the subject compositions for a wide variety of fabric laundering purposes, including removal of protein-based, carbohydrate-based, or triglyceride-based stains, for example, and for the prevention of refugee dye transfer, and for fabric restoration. The enzymes which may be incorporated include proteases, amylases, lipases, cellulases, and peroxidases, as well as mixtures of two or more thereof. Other types of enzymes may also be included. They may be of any suitable origin, such as vegetable, animal, bacterial, fungal and yeast origin. However, their choice is governed by several factors such as pH-activity and/or stability optima, thermostability, stability in the presence of active detergents, builders and so on. In this respect bacterial or fungal enzymes are preferred, such as bacterial amylases and proteases, and fungal cellulases.

The subject compositions typically comprise up to about 5%, preferably from about 0.01% to about 2%, more preferably about 0.2% to about 1%, of commercial enzyme preparations.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based strains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130 756, published Jan. 9, 1985) and Protease B (see European Patent Application 251 446, published Jan. 7, 1988).

Protease enzymes in commercial preparations are included in the subject compositions at levels sufficient to provide from about 0.004 to about 2 Anson units (AU) of activity per gram of the compositions, preferably from about 0.006 to about 0.1 AU, also from about 0.005 to about 0.02 AU.

Amylases include, for example, α-amylases described in British Patent Specification No. 1,296,839 (Novo), RAPIDASE®, International Bio-Synthetics, Inc. and TERMAMYL®, Novo Industries. Amyulase is preferably included in the subject compositions such that the activity of the amylase is from about 0.02 KNU to about 5 KNU per gram of the composition, more preferably from about 0.1 KNU to about 2 KNU, more preferably still from about 0.3 KNU to about 1 KNU. (KNU is a unit of activity used commercially by Novo Ind.)

The cellulases usable in the subject compositions include both bacterial and fungal cellulase. Preferably, they will have a pH optimum of between 5 and 9.5. Suitable cellulases are disclosed in U.S. Pat. No. 4,435,307, Barbesgoard et al., issued Mar. 6, 1984, which discloses fungal cellulase produced from Humicola insolens and Humicola strain DSM1800, a cellulase 212-producing fungus belonging to the genus Aeromonas, and cellulase extracted from the hepatopancreas of a marine mollusk (Dolabella Auricula Solander). Suitable cellulases are also disclosed in British Patent Sec. Nos. 2,075,028 and 2,095,275 and German Patent Spec. No. 2,247,832. Cellulases disclosed in PCT Patent Application No. WO 91/17243, such as CAREZYME® (Novo), are especially useful cellulases.

Cellulase is preferably included in the subject compositions such that the activity of the cellulase is from about 0.1 CEVU to about 20 CEVU per gram of the composition, more preferably from about 1 CEVU to about 10 CEVU, more preferably still from about 2 CEVU to about 5 CEVU. (The activity of a cellulase material (CEVU) is determined from the viscosity decrease of a standard CMC solution as follows. A substrate solution is prepared which contains 35 g/l CMC (Hercules 7 LFD) in 0.1 M tris buffer at pH 9.0. The cellulase sample to be analyzed is dissolved in the same buffer. 10 ml substrate solution and 0.5 ml enzyme solution are mixed and transferred to a viscosimeter (e.g., Haake VT 181, NV snesor, 181 rpm), thermostated at 40° C. Viscosity readings are taken as soon as possibly after mixing and again 30 minutes later. The activity of a cellulase solution that reduces the viscosity of the substrate solution to one half under these conditions is defined as 1 CEVU/liter.)

In addition to its ability to interact with alkylbenzene sulfonate to provide good cleaning in underbuilt wash conditions, it has also been found surprisingly that low levels of AES surfactant can reduce or prevent the deactivation of cellulase enzymes which can be observed in LAS-based detergent formulations. Without being bound by any theory, it is believed that LAS can reduce the activity of cellulase enzymes by disrupting the protein structure thereof. Surprisingly it has been found that a low level of AES surfactant can reduce the deactivating effect of LAS on cellulase enzymes. This permits lower levels of cellulase enzyme to be used, thereby reducing the enzyme cost and increasing the value of the product for the consumer.

Suitable lipase enzymes for detergent usage include those produced by microorganisms of the Pseudomonas group, such a *Pseudomonas stutzeri* ATCC 19.154, as disclosed in British Patent 1,372,034. See also lipases in Japanese Patent Application 53/20487, laid open to public inspection on Feb. 24, 1978. This lipase is available from Amano Pharmaceutical Co. Ltd., Nagoya, Japan, under the trade name Lipase P. Other commercial lipases include Amano-CES, lipases ex Chromobacter viscosum, e.g., Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EP 341 947) is a preferred lipase.

Lipase is preferably included in the subject compositions such that the activity of the lipase is from about 0.001 KLU to about 1 KLU per gram of the composition, more preferably from about 0.01 KLU to about 0.5 KLU, more preferably still from about 0.02 KLU to about 0.1 KLU. (KLU is a unit of activity used commercially by Novo Ind.)

Peroxidase enzymes are used in combination with oxygen sources, e.g., percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al., issued Jul. 18, 1978, and in U.S. Pat. No. 4,507,219, Hughes, issued Mar. 26, 1985.

Enzymes for use in detergents can be stabilized by various techniques. Enzyme stabilization techniques are disclosed and exemplified in U.S. Pat. No. 3,600,319, issued Aug. 17, 1971 to Gedge et al., and European Patent Application No. 199 405, published Oct. 29, 1986, Venegas. Enzyme stabilization systems are also described, for example, in U.S. Pat. No. 3,519,570.

Bleaching Compounds

Bleaching Agents and Bleach Activators

The subject detergent compositions may optionally contain bleaching agents or bleaching compositions containing a bleaching agent and one or more bleach activators. When present, bleaching agents will typically be at levels up to about 20%, preferably from about 1% to about 5%, of the subject compositions. If present, the amount of bleach activators will typically be up to about 70%, preferably from about 0.5% to about 5% of the subject compositions.

The bleaching agents can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used. A preferred level of perborate bleach in the subject composition is from about 1% to about 2%, more preferably from about 1.2% to about 1.5%.

Another category of bleaching agent that can be used encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, European Patent Application 133 354, Banks et al., published Feb. 20, 1985, and U.S. Pat. No. 4,412,934 Chung et al., issued Nov. 1, 1983. Bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE®, manufactured commercially by DuPont) can also be used.

A preferred percarbonate bleach comprises dry particles having an average particle size in the range from about 500 micrometers to about 1,000 micrometers, not more than about 10% by weight of such particles being smaller than about 200 micrometers and not more than about 10% by weight of such particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various non limiting examples of activators are disclosed in U.S. Pat. No. 4,915,854, issued Apr. 10, 1990 to Mao et al., and U.S. Pat. No. 4,412,934. The nonanoyloxybenzene sulfonate (NOBS) and tetraacetyl ethylenediamine (TAED) activators are typical, and mixtures thereof can also be used. A preferred level of NOBS or TAED bleach activator in the subject compositions is from about 0.5% to about 2%, more preferably from about 0.8% to about 1.5%, more preferably still from about 1% to abut 1.3%.

See also U.S. Pat. No. 4,634,551 for other typical bleaches and activators.

Fabric Softening Clay

A preferred fabric softening clay is a smectite-type clay. The smectite-type clays can be described as expandable, three-layer clays; i.e., alumino-silicates and magnesium silicates, having an ion exchange capacity of at least about 50 meq/100 g of clay. Preferably the clay particles are of a size that they cannot be perceived tactilely, so as not to have a gritty feel on the treated fabric of the clothes. The fabric softening clay, if it is included, can be added to the subject invention compositions to provide about 0.1% to about 20% by weight of the composition, more preferably from about 0.2% to about 15%, and more preferably still about 0.3% to 10%.

While any of the smectite-type clays are useful in the subject invention compositions, certain clays are preferred. For example, Gelwhite GP is an extremely white form of smectite-type clay and is therefore preferred when formulating white detergent compositions. Volclay BC, which is a smectite-type clay mineral containing at least 3% iron (expressed as $Fe_2O_3$) in the crystal lattice, and which has a very high ion exchange capacity, is one of the most efficient and effective clays for use in the instant compositions from the standpoint of product performance. On the other hand, certain smectite-type clays are sufficiently contaminated by other silicate minerals that their ion exchange capacities fall below the requisite range; such clays are not preferred in the subject compositions.

Clay Flocculating Agent

It has been found that the use of a clay flocculating agent in a composition containing softening clay provides improved softening clay deposition onto the clothes which results in better clothes softening performance, compared to that of compositions comprising softening clay alone. The polymeric clay flocculating agent is selected to provide improved deposition of the fabric softening clay. Typically such materials have a high molecular weight, greater than about 100,000. Examples of such materials can include long chain polymers and copolymers derived from monomers such as ethylene oxide, acrylamide, acrylic acid, dimethylamino ethyl methacrylate, vinyl alcohol, vinyl pyrrolidone, and ethylene imine. Gums, like guar gums, are suitable as well. The preferred clay flocculating agent is a poly(ethylene oxide) polymer. The amount of clay flocculating agent included in the subject compositions, if any, is about 0.2%–2%, preferably about 0.5%–1%.

Dye Transfer Inhibiting Ingredient

Another preferred optional component in the subject compositions is a dye transfer inhibiting (DTI) ingredient to prevent diminishing of color fidelity and intensity in fabrics. A preferred DTI ingredient can include polymeric DTI materials capable of binding fugitive dyes to prevent them from depositing on the fabrics, and decolorization DTI materials capable of decolorizing the fugitive dyes by oxidation. An example of a decolorization DTI is hydrogen peroxide or a source of hydrogen peroxide, such as percarbonate or perborate. Non-limiting examples of polymeric DTI materials include polyvinylpyrridine N-oxide, polyvinylpyrrolidone (PVP), PVP-polyvinylimidazole copolymer, and mixtures thereof. Copolymers of N-vinylpyrrolidone and N-vinylimidazole polymers (referred to as "PVPI") are also preferred. The amount of DTI included in the subject compositions, if any, is about 0.05%–5%, preferably about 0.2%–2%.

Photobleaches

A preferred optional component of the subject invention composition is a photobleach material, particularly phthalocyanine photobleaches which are described in U.S. Pat. No. 4,033,718 issued Jul. 5, 1977, incorporated herein by reference. Preferred photobleaches are metal phthalocyanine compounds, the metal preferably having a valance of +2 or +3; zinc and aluminum are preferred metals. Such photobleaches are available, for example, under the tradename TINOLUS. Zinc phthalocyanine solfonate is available commercially under the tradename QUANTUM® from Ciba Geigy. The photobleach components, if included, are typically in the subject compositions at levels up to about 0.02%, preferably from about 0.001% to about 0.015%, more preferably from about 0.002% to about 0.01%.

Fillers

Sodium sulfate and calcium carbonate (also known as Calcarb) are well known and often used as filler components of the subject compositions. Fillers also include minerals, such as talc and hydrated magnesium silicate-containing minerals, where the silicate is mixed with other minerals, e.g., old mother rocks such as dolomite. Sodium sulfate is a preferred filler material. Filler materials, if included, are typically at levels up to about 60%, preferably from about 25% to about 50%.

Optical Brighteners

Any optical brighteners or other brightening or whitening agents known in the art can be incorporated into the subject detergent compositions. Commercial optical brighteners which may be useful can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered ring heterocycles, and other miscellaneous agents. Examples of such brighteners are disclosed in "The Product and Application of Fluorescent Brightening Agents", M. Zahradnik, Published by John Wiley & Sons, New York (1982). Anionic brighteners are preferred.

Specific examples of optical brighteners which are useful in the subject compositions are those identified in U.S. Pat. No. 4,790,856, issued to Wixon on Dec. 13, 1988. These brighteners include the PHORWHITE® series of brighteners from Verona. Other brighteners disclosed in this reference include: TINOPAL UNPA®, TINOPAL CBS® and TINOPAL 5BM®, TINIPAL AMS-GX®, available from Ciba-Geigy: ARTIC WHITE CC® and ARTIC WHITE CWD®, available from Hilton-Davis, located in Italy; the 2-(4-strylphenyl)-2H-napthol[1,2-d]triazoles; 4,4'-bis(1,2,3-triazol-2-yl)-stilbenes; 4,4'-bis(stryl)bisphenyls; and the aminocoumarins. Specific examples of these brighteners include 4-methyl-7-diethylamino coumarin; 1,2-bis(-benzimidazol-2-yl)ethylene; 1,3-diphenylphrazolines; 2,5-bis(benzoxazol-2-yl)thiophene; 2-stryl-napth-[1,2-d] oxazole; and 2-(stilbene-4-yl)-2H-naphtho-[1,2-d]triazole. See also U.S. Pat. No. 3,646,015, issued Feb. 29, 1972 to Hamilton.

Preferred brighteners also include 4,4'-bis((4-anilino-6-bis(2-hydroxyethyl)-amino-1,3,5-trizin-2-yl)amino) stilbene-2,2'-disulfonic acid disodium salt, 4-4'-bis(2-sulfostyryl)biphenyl (BR2) and 4,4'-bis((4-anilino-6-morpholino-1,3,5-triazin-2-yl)-amino)stilbene-2,2'-disulfonic acid disodium salt.

Such optical brighteners, or mixtures thereof, if included, are typically at levels in the compositions up to about 1%, preferably about 0.01%–0.3%.

The compositions of the subject invention typically comprise from about 3% to about 15% water, preferably from about 4% to about 12% water, more preferably from about 5% to about 9% water.

Miscellaneous

Dyes pigments, germicides, perfumes, polyethylene glycol, glycerine, sodium hydroxide, alkylbenzene, fatty alcohol, and other minors, some of which are impurities carried in from surfactant-making processes, can also be incorporated in the subject compositions. If included, they are typically at levels up to about 3%.

Methods

Hardness Tolerance Test

All glassware used is cleaned and dried thoroughly. The sample concentrations used are based on the anhydrous form of the target surfactant for which hardness tolerance is being examined. The target surfactant can be a single anionic surfactant, or a mixture of anionic surfactants (such as alkyl benzene sulfonate and alkyl sulfate). If the formulation contains additional anionic, cationic, or other surfactants, these are added in additional amounts. The experiment is run at 22±1° C.

A 20 g surfactant solution is prepared containing 4500 ppm of the sodium salt of the target surfactant for which the Hardness Tolerance is to be measured, 5500 ppm sodium tripolyphosphate, 3250 ppm sodium carbonate, 5295 ppm sodium sulfate, and additional amounts of other anionic, cationic or other surfactant, by dissolving each component in de-ionized water at the indicated concentrations. The 20 g surfactant solution is added to 180 g of a test water having a specified water hardness in units of grains per gallon, using a 3:1 molar ratio of $Ca^{++}$:$Mg^{++}$ ions. The resulting 200 g test solution is shaken vigorously for 30 seconds and then allowed to stand for 40 minutes. If any cationic surfactant is present, the solution is first passed through a cationic exchange column to remove any cationic surfactant from the solution. A 10 mL aliquot of the resulting test solution is filtered though a 0.1 mM Gelman Acrodisk syringe filter (VWR Scientific, cat. no. 28143-309). The first 2 mL of the filtrate are discarded and the remaining 8 mL of the filtrate are collected for analysis. The surfactant concentration (in ppm) in the collected filtrate, $C_{surf}$, is then measured quantitatively by a suitable analytical technique, e.g., a two-phase titration such as the international standard method ISO 2271 described in Introduction To Surfactant Analysis; Cullum, D. C., Ed.; Blackie Academic and Professional, Glasgow, 1994; pp 59–64. This surfactant concentration $C_{surf}$ will account for the precipitate of any anionic surfactant (including, for example, alkyl benzene sulfonates, alkyl sulfates, alkyl ethoxy ether sulfates, etc.) present in the solution. Preferably, this method is used only when the relative amounts of the other anionic surfactants is small relative to the target surfactant(s).

The hardness tolerance result in this test is expressed as the % loss of the surfactant being tested according to the following formula:

$$\%\ \text{loss}=([450\ \text{ppm}-C_{surf}(\text{ppm})]+450\ \text{ppm})\times 100\%$$

EXAMPLES

Example A

Employing the Hardness tolerance method described above, the alkyl ethoxy ether sulfate (AES) was added to a surfactant base of a target anionic surfactant LAS and an additional cationic surfactant HAQA.

| Test Water hardness | Base surfactant system -450 ppm LAS -16 ppm HAQA | Invention System -450 ppm LAS -16 ppm HAQA -37.5 ppm AES |
|---|---|---|
| | Target surfactant precipitated, % | |
| 0 gpg | 0 | 0 |
| 25 gpg | 41 | 23 |
| 36 gpg | 48 | 31 |
| 50 gpg | nm | 44 |

LAS is the target anionic surfactant, linear $C_{11}$–$C_{13}$ alkyl benzene sulfonate, sodium salt.

AES is an anionic surfactant, linear $C_{12}$–$C_{15}$ ethoxy(3) sulfate, sodium salt.

ADHQ is a cationic surfactant, linear $C_{12}$–$C_{14}$ dimethyl hydroxyethyl quaternary ammonium chloride.

"nm" is "not measured".

The results show that the addition of AES reduces the amount of LAS surfactant precipitated by water hardness in the test water solution, and therefore lost for cleaning performance.

Since it is an anionic surfactant, the collected precipitate may include precipitated AES. However, it is known that AES is affected less than LAS by water hardness, and the amount of AES is low relative to the amount of LAS (less than 10% level of the LAS).

Formula Examples

The following are example compositions of the subject invention, but are not intended to be limitations of the scope of the subject invention. The examples are granular detergents which can be made by well-known processes, such as spray drying of a paste or slurry, and agglomerating or dry blending in mixers.

The following list of components are utilized in the examples.

LAS: linear $C_{11}$–$C_{13}$ alkylbenzene sulfonate, sodium salt.
AES: linear $C_{12}$–$C_{15}$ ethoxy(3) sulfate, sodium salt.
AS: linear $C_{14}$–$C_{15}$ alkyl sulfate, sodium salt.
ADHQ: linear $C_{12}$–$C_{14}$ dimethyl hydroxyethyl quaternary ammonium chloride.
AE: linear $C_{14}$–$C_{15}$ ethoxy (7) alcohol.
STPP: sodium tripolyphosphate.
Silicate: sodium silicate having a $SiO_2$:$Na_2O$ ratio of 1.6.
Carbonate: sodium carbonate.
Zeolite: Zeolite A
DTPA: diethylenetriaminepentaacetate, sodium salt.
SOKALAN®: copolymer of acrylic and maleic acids, designated HP-22 from BASF.
PEI 1800 $E_7$: soil dispersing agent described hereinabove.
CMC: carboxymethyl cellulose having an average molecular weight of 63,000.
SRA-1: polymeric soil release agent described hereinabove.
SAVINASE/BAN®: protease and amylase enzyme product designated 6/100T from Novo Industries A/S.
CAREZYME®: cellulase enzyme product designated 5T from Novo Industries A/S, having an activity of 5000 CEVU/g.
LIPOLASE®: lipase enzyme product designated 100T from Novo Industries A/S.
Perborate: sodium perborate monohydrate.
NOBS: nonanoyloxybenzene sulfonate, sodium salt.
ZPS: zinc phtalocyanine sulfonate.
Br 2: 4-4'-bis(2-sulfostyryl)biphenyl.
Sulfate: sodium sulfate.

The numbers in the following table are weight percents.

TABLE A

| Components | Formulae 1–6 | | | | | |
|---|---|---|---|---|---|---|
| | 1 | 2 | 3 | 4 | 5 | 6 |
| LAS | 18 | 18 | 18 | 20 | 18 | 21 |
| AES | 1.5 | 1.5 | 1.5 | 1.5 | 1.5 | 1.75 |
| AS | — | — | — | — | — | — |
| ADHQ | 0.6 | 0.6 | 0.6 | 0.7 | 0.6 | 0.7 |
| AE | 0.4 | 0.5 | — | — | — | 0.6 |
| STPP | 13 | 14 | 24 | 14 | 19 | 14 |
| Silicate | 7.5 | 7.5 | 7.5 | 7.5 | 7.5 | 7.5 |

TABLE A-continued

| Components | Formulae 1–6 | | | | | |
|---|---|---|---|---|---|---|
| | 1 | 2 | 3 | 4 | 5 | 6 |
| Carbonate | 9 | 9 | 9 | 9 | 9 | 9 |
| Zeolite | 1.5 | — | — | — | — | — |
| DTPA | 0.9 | 0.3 | 0.3 | 0.3 | 0.3 | 0.3 |
| SOKALAN ® | 0.9 | 0.6 | 0.6 | 0.6 | 1.2 | 0.6 |
| PEI 1800 $E_7$ | — | 0.35 | 0.35 | 0.35 | 0.35 | 0.35 |
| CMC | 0.35 | 0.2 | 0.2 | 0.2 | 0.8 | 0.2 |
| SRA-1 | 0.2 | 0.2 | 0.2 | 0.2 | 0.2 | 0.2 |
| SAVINASE/BAN ® | 0.54 | 0.45 | 0.45 | 0.45 | 0.45 | 0.45 |
| CAR-EZYME ® | 0.07 | 0.07 | 0.07 | 0.07 | 0.07 | 0.07 |
| LIPOLASE ® | — | 0.08 | 0.08 | 0.08 | 0.08 | 0.08 |
| Perborate | 1.35 | — | — | — | — | — |
| NOBS | 1.15 | — | — | — | — | — |
| ZPS | 0.007 | 0.007 | 0.007 | 0.007 | 0.007 | 0.007 |
| Br2 | 0.04 | 0.04 | 0.04 | 0.04 | 0.04 | 0.04 |
| Perfume | 0.3 | 0.31 | 0.31 | 0.31 | 0.31 | 0.31 |
| Moisture | 5.6 | 5.9 | 8.9 | 5.9 | 7.4 | 5.9 |
| Sulfate | balance | balance | balance | balance | balance | balance |

TABLE B

| Components | Formuli 7–12 | | | | | |
|---|---|---|---|---|---|---|
| | 7 | 8 | 9 | 10 | 11 | 12 |
| LAS | 18 | 18 | 18 | 14 | 9 | 18 |
| AES | 0.8 | 1.5 | 1.5 | 1.5 | 1.5 | 1.0 |
| AS | — | — | — | 4 | 9 | — |
| ADHQ | 0.6 | 0.6 | 0.6 | 0.6 | 0.7 | 0.6 |
| AE | 0.4 | 0.4 | 0.5 | 0.4 | 0.4 | 0.4 |
| STPP | 36 | 18 | 31 | 14 | 14 | 13 |
| Silicate | 5 | 7.5 | 5 | 7.5 | 7.5 | 7.5 |
| Carbonate | 9 | 9 | 9 | 9 | 9 | 9 |
| Zeolite | — | — | — | — | — | — |
| DTPA | 0.9 | 0.9 | 0.9 | 0.3 | 0.9 | 0.9 |
| SOKALAN ® | 0.9 | 0.9 | 0.6 | 0.6 | 0.6 | 0.9 |
| PEI 1800 $E_7$ | — | — | — | — | — | 0.35 |
| CMC | 0.35 | 0.55 | 0.35 | 0.3 | 0.3 | 0.35 |
| SRA-1 | 0.2 | 0.2 | 0.2 | 0.2 | 0.2 | 0.2 |
| SAVINASE/BAN ® | 0.54 | 0.54 | 0.54 | — | — | 0.54 |
| CAR-EZYME ® | 0.07 | 0.07 | 0.07 | 0.07 | 0.07 | 0.07 |
| LIPOLASE ® | — | — | — | — | — | — |
| Perborate | 1.35 | 2.41 | 1.35 | — | — | 1.35 |
| NOBS | 1.15 | 1.21 | 1.15 | — | — | 1.15 |
| ZPS | 0.007 | 0.009 | 0.045 | 0.007 | 0.007 | 0.007 |
| Br2 | 0.04 | 0.04 | 0.2 | 0.04 | 0.04 | 0.04 |
| Perfume | 0.3 | 0.32 | 0.31 | 0.30 | 0.30 | 0.3 |
| Moisture | 5.6 | 7.0 | 11.0 | 6.0 | 6.0 | 5.6 |
| Sulfate | balance | balance | balance | balance | balance | balance |

TABLE C

| Components | Formuli 13–18 | | | | | |
|---|---|---|---|---|---|---|
| | 13 | 14 | 15 | 16 | 17 | 18 |
| LAS | 18 | 18 | 21 | 18 | 18 | 20 |
| AES | 1.0 | 1.5 | 1.2 | 1 | 1 | 0.8 |
| AS | — | — | — | — | — | — |
| ADHQ | 0.5 | 0.6 | 0.7 | 0.6 | 0.6 | 0.7 |
| AE | — | 0.5 | — | 0.8 | — | — |
| STPP | 24 | 24 | 20 | — | — | 36 |
| Silicate | 7.5 | 7.5 | 7.5 | 5 | 7.0 | 7.5 |
| Carbonate | 9 | 9 | 13 | 9 | 13 | 9 |
| Zeolite | — | — | — | 24 | 24 | — |
| SOKALAN ® | 1.0 | 0.6 | 0.6 | 1.0 | 1.0 | 0.6 |
| Br2 | 0.30 | 0.04 | 0.08 | 0.10 | 0.10 | 0.10 |

TABLE C-continued

| Components | Formuli 13–18 | | | | | |
|---|---|---|---|---|---|---|
| | 13 | 14 | 15 | 16 | 17 | 18 |
| Perfume | 0.31 | 0.31 | 0.3 | 0.28 | 0.28 | 0.25 |
| Moisture | 8.9 | 8.9 | 5.6 | 6.0 | 6.0 | 5.9 |
| Sulfate | balance | balance | balance | balance | balance | balance |

The subject invention includes processes for laundering fabrics using the compositions described hereinabove. Preferred processes are hand washing operations and machine-assisted hand washing operations using such compositions.

The subject processes include incorporating the subject compositions in water, typically at concentrations of from about 1000 ppm to about 900 ppm, preferably from about 1500 ppm to about 7500 ppm, more preferably from about 2000 ppm to about 6000 ppm, in which fabrics are washed. The subject washing operations preferably are carried out at wash solution temperatures of from about 10° C. to about 60° C., more preferably from about 12° C. to about 40° C. The subject wash solutions are preferably within the pH range of from about 8 to about 11, more preferably from about 9.8 to about 10.5

While particular embodiments of the subject invention have been described hereinabove, it will be obvious to those skilled in the art that various changes and modifications to the subject invention can be made without departing from the spirit and scope of the invention. It is intended to cover, in the appended claims, all such modifications that are within the scope of this invention.

What is claimed is:

1. A detergent composition comprising a) from about 15% to about 30% surfactant, the surfactant comprising:

(1) from about 70%, to about 93%, alkylbenzene sulfonate surfactant, the alkyl being alkanyl or alkenyl or a mixture thereof and having an average of from about 10 to about 14 carbon atoms;

(2) from about 4%, to about 12%, alkyl ethoxy ether sulfate surfactant having an average of from about 1 to about 7 moles ethoxy per mole surfactant, the alkyl being alkanyl or alkenyl or a mixture thereof and having an average of from about 11 to about 18 carbon atoms, the ratio of alkylbenzene sulfonate surfactant to alkyl ethoxy ether sulfate surfactant being within the range of from about 19:1, to about 8:1;

(3) from about 2.5%, to about 4.5%, of hydroxyalkyl quaternary ammonium cationic surfactant, R being alkanyl or alkenyl and having an average of from about 10 to about 15 carbon atoms, each R' being methyl, the ratio of alkylbenzene sulfonate surfactant to such cationic surfactant being within the range of from about 40:1, to about 20:1;

(4) from 0% to about 8% alkyl ethoxy alcohol surfactant having an average of from about 3 to about 10 moles ethoxy per mole surfactant, the alkyl being alkanyl or alkenyl or a mixture thereof having an average of from about 11 to about 18 carbon atoms, the ratio of alkylbenzene sulfonate surfactant to alkyl ethoxy alcohol surfactant being greater than about 10:1; and b) cellulase enzyme having an activity of from about 1 CEVU to about 10 CEVU per gram of the composition; and c) from about 60% to about 95% other components.

2. The composition of claim 1 wherein the composition comprises from about 7% to about 50% builders selected from polyphosphate, aluminosilicate, and mixtures thereof.

3. The composition of claim 1 wherein the composition has a cellulase enzyme activity of from about 2 CEVU to about 5 CEVU per gram of the composition.

4. The composition of claim 3 wherein the composition comprises from about 1% to about 6.5% perborate bleach, and from about 0.5% to about 3.0% bleach activator.

* * * * *